US009179790B2

(12) United States Patent
Messina

(10) Patent No.: US 9,179,790 B2
(45) Date of Patent: Nov. 10, 2015

(54) HOUSEHOLD LINEN FOR A DOUBLE BED

(76) Inventor: Solange Messina, Levallois-Perret (FR)

( * ) Notice: Subject to any disclaimer, the term of this patent is extended or adjusted under 35 U.S.C. 154(b) by 0 days.

(21) Appl. No.: 14/233,818

(22) PCT Filed: Jul. 18, 2012

(86) PCT No.: PCT/FR2012/051695
§ 371 (c)(1),
(2), (4) Date: Apr. 24, 2014

(87) PCT Pub. No.: WO2013/011237
PCT Pub. Date: Jan. 24, 2013

(65) Prior Publication Data
US 2014/0352062 A1 Dec. 4, 2014

(30) Foreign Application Priority Data
Jul. 18, 2011 (FR) ..... 11 02229

(51) Int. Cl.
*A47G 9/02* (2006.01)

(52) U.S. Cl.
CPC ..... *A47G 9/0261* (2013.01); *A47G 9/023* (2013.01); *A47G 9/0238* (2013.01)

(58) Field of Classification Search
CPC ..... A47G 9/00–2009/0276
USPC ..... 5/486, 482, 495, 496, 502, 923
See application file for complete search history.

(56) References Cited

U.S. PATENT DOCUMENTS 2,730,728 A * 1/1956 Roberts ..... 5/486
3,072,776 A * 1/1963 Quenneville ..... 5/486
4,005,499 A * 2/1977 Klein ..... 5/485
5,287,573 A * 2/1994 Ritacco ..... 5/486
5,943,717 A * 8/1999 Alexander ..... 5/486
6,226,814 B1 * 5/2001 Alexander ..... 5/486
6,311,347 B1 * 11/2001 Limardi et al. ..... 5/486
6,341,396 B1 * 1/2002 Carapezza ..... 5/482
7,100,223 B1 * 9/2006 Anthony ..... 5/486
7,971,293 B1 * 7/2011 Helton ..... 5/486
8,245,334 B2 * 8/2012 Cohen ..... 5/501
8,522,378 B2 * 9/2013 Argento ..... 5/486
2003/0121100 A1 * 7/2003 Fabian ..... 5/486

OTHER PUBLICATIONS

ISR From PCT/FR2012/051695.

* cited by examiner

*Primary Examiner* — Peter M Cuomo
*Assistant Examiner* — Brittany Wilson

(57) ABSTRACT

The invention relates to a household linen for a double bed with two elongated panels (2.3) that:

are linked in at least one region, called the foot, (Rp) intended to be located at the foot end of the bed, are free relative to each other on the major portion of their length up to a head edge (Bt) located opposite the foot region (Rp)

and partly overlap at a central longitudinal region (Rm) of the linen, so that the width ($I_l$) of the linen is less than the sum of the width (Ip) of the two panels (2,3), the middle region extending between the foot region (Rp) and the head edges (Bt), characterized in that each overlapping region (Rc) of each panel (2,3) is separated from the foot region by a cut-out (15) substantially transverse to a longitudinal axis of the household linen (M).

15 Claims, 4 Drawing Sheets

HOUSEHOLD LINEN FOR A DOUBLE BED

The present invention relates to the technical field of household linen including the field of bed linen. The invention relates more particularly to the field of top sheets, quilts or blankets for covering at least a part of the user or users of a double bed when in the bed.

In the field of double beds or beds for two persons, it is common when both users are lying side by side for sleeping, that a user wishes to be covered to "keep warm" while the other user wants to be discovered because on the contrary, he is too hot. Now, linen for double bed known to date do not satisfy comfortable and practical needs of these sleeping conditions a priori antagonistic. Indeed, with the top sheets or duvets or blankets for double bed known, the only possible solution is, for the person not wishing to be covered, to place at the center of the bed the its part of the linen. However, the unused portion then forms between the two sleepers, an accumulation reducing the sleeping surface available and thereby affects the comfort of two users.

It thus appeared the need for a new type of linen for double bed which provides a solution to antagonist needs of comfort of two users in the same bed while not having the drawbacks of linen known to date.

To achieve this objective, the invention relates to a household linen for a double bed, linen comprising two elongated panels that:

- are linked in at least one region, called the foot, intended to be located at the foot end of the bed,
- are free relative to each other on the major portion of their length up to a head edge located opposite the foot region and partly overlap at a central longitudinal region of the linen, so that the width of the linen is less than the sum of the width of the two panels, the middle region extending between the foot region and the head edges characterized in that each overlapping region of each panel is separated from the foot region by a cut-out substantially transverse to a longitudinal axis of the household linen.

The implementation of such a linen allows each of the two users of the double bed to be covered or discovered independently of each other so that a user can partially or completely be covered, while the other is partially or fully discovered. Furthermore, the independence of the two panels on the major part of their length in the middle region of the linen according to the invention allows the user who does not wish to be covered to place the corresponding linen panel at the foot of the bed. Thus, the unused panel does not form an annoying and uncomfortable accumulation on the bed as is the case for a double bed linen in the prior art. Moreover, the fact that each panel have a width greater than half the total width of the linen enables when both users are covered to avoid, because of the area of coverage, an opening for an air passage. Similarly the fact that each panel has a width greater than half of the total width of the linen enables the user who has chosen to be covered while the other is uncovered, to be covered on both sides and on top, over the entire length of the lateral zone without air passage which contributes to the comfort of use of the linen according to the invention. Independent panels also allow use of the linen according to the invention, a double bed implementing independent mattress on box springs also independent and articulated. Indeed, each linen panel according to the invention can then follow the movements of each mattress without affecting the configuration of the other panel. Furthermore, the presence of the cut-out increases the independence of the linen panels and contributes to the overall aesthetics of the linen according to the invention.

According to one characteristic of the invention, the foot regions of the panels are separable and are connected by detachable connecting means. The removable nature of foot panel facilitates washing and folding of the linen according to the invention. The connecting means of the foot regions can be made in any suitable manner and include, for example, stringers hook intended to cooperate with stringers loop as marketed under the name "Velcro".

However, according to the invention the foot regions of the panels may also form a single foot panel or a single piece so that the elongate panels are not separable.

According to one characteristic of the invention, each overlapping region have a width, as measured between a inner longitudinal edge of the corresponding panel and the inner longitudinal edge of the other panel, greater than or equal to 15 cm. The width of the overlapping region ensures good coverage of the user on either side along its length. In the case of a linen according to the invention for a double bed for twin babies for each overlapping region has a width greater than or equal to 15 cm and for example between 15 cm and 20 cm. In the case of a linen according to the invention for a double bed for adult, the width of each overlapping region is preferably greater than or equal to 30 cm, for example, between 30 cm and 50 cm. Of course the bed linen according to the invention can bespoke to fit the dimensions of the bed on which it is intended to be implemented and also depending on comfort criteria determined by the users.

According to the invention the length of each panel measured from the transverse head edge and transverse foot edge is adapted to fit the bed. In the case of a linen according to the invention for a double bed for adults, the length of each panel measured between the head transverse edge and the foot transverse edge may be greater than or equal to 150 cm and preferably greater than or equal 200 cm to provide better comfort.

According to the invention the width of the linen measured between the outer longitudinal edges of the panels is adapted to fit the width of the bed. In the case of a linen according to the invention for a double bed for adults the linen width measured between the outer longitudinal edges of the panels may be greater than or equal to 110 cm and preferably greater than or equal to 120 cm, each panel having a width, measured from the outer longitudinal edge and its inner longitudinal edge, greater than or equal to 70 cm and preferably greater than or equal to 80 cm.

According to one characteristic of the invention, the two panels each comprise complementary demountable joining means located at their overlap zone to linked or disconnect them very easily. These joining means allow fastening the panels when users wish to be covered at the same time. Such removable joining means also facilitate bed preparation and layout of the linen according to the invention. The removable joining means also contribute to the overall aesthetics of the bed when not in use.

According to a variant of this characteristic, the removable joining means comprise flexible textile linkages. The implementation of such textile links, to tie, ensures comfort to user of linen according to the invention. The releasable joining means may also include flexible straps, soft snaps, or other soft grip.

According to another variant of this characteristic, the linen according to the invention comprises near the head end of the panels. The linen may also include such removable joining means distributed along the connecting zone.

According to the invention the household linen can be of various types such as sheet, blanket, or other. Thus, according to one embodiment of a household linen for a double bed according to the invention, each panel forms a so-called bag for a feather bed adapted to receive a feather bed, blanket or the like which can be consistent for all or part to the linen according to invention.

According to another embodiment of the invention, each panel is at least partly made of a textile or an assembly of thick textile, blanket type or padded fabrics.

According to yet another embodiment of the invention household linen each panel comprises a single thickness of fabric.

Of course the different features, embodiments and variants of the invention may be combined with each other in various combinations to the extent that they are not incompatible or mutually exclusive of the other.

In addition, various other features of the invention emerge from the annexed description given with reference to drawings which illustrate non-limiting embodiments of household linens for a double bed according to the invention.

Figure 4:
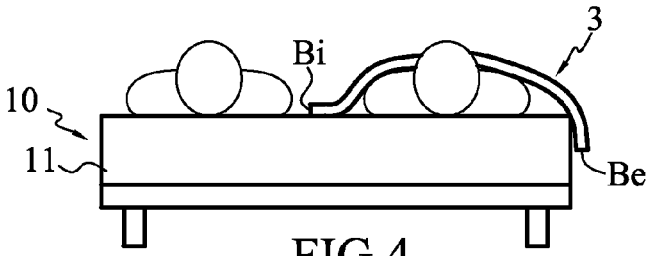
FIG. 4 is a side view from the head of the bed of the household linen set according to the invention in the scenario of the double bed shown in FIG. 3.
Figure 6:
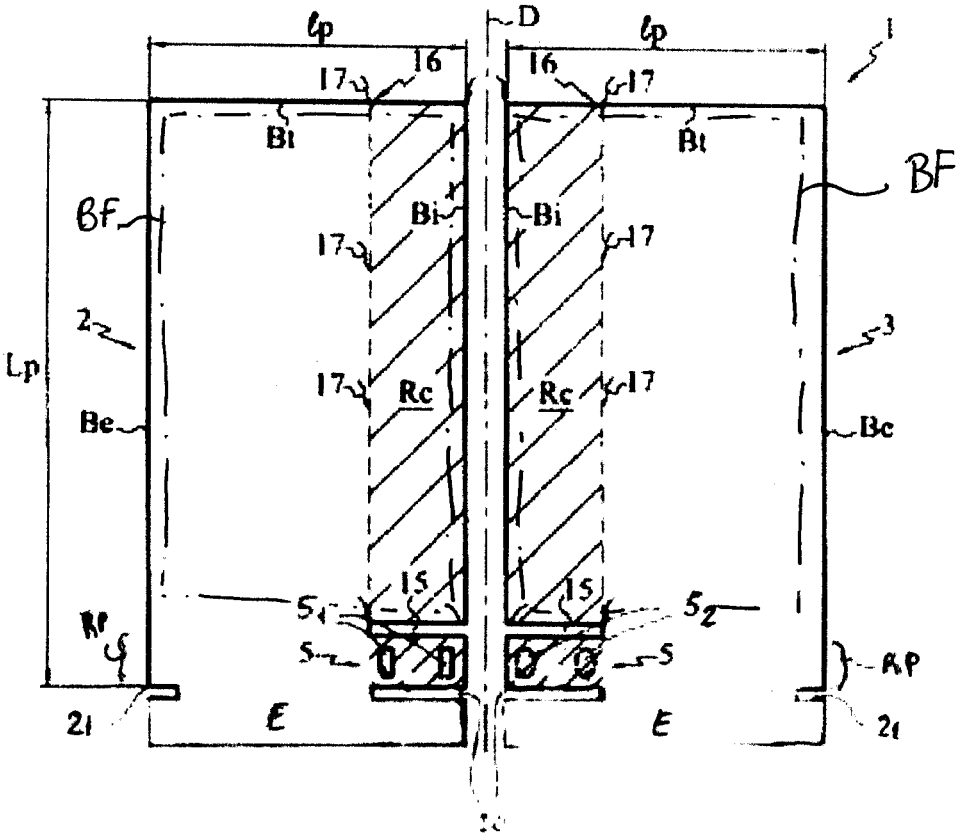
FIG. 6 is a view similar to FIG. 1 showing an alternative quilt bag according to the invention.
Figure 7:
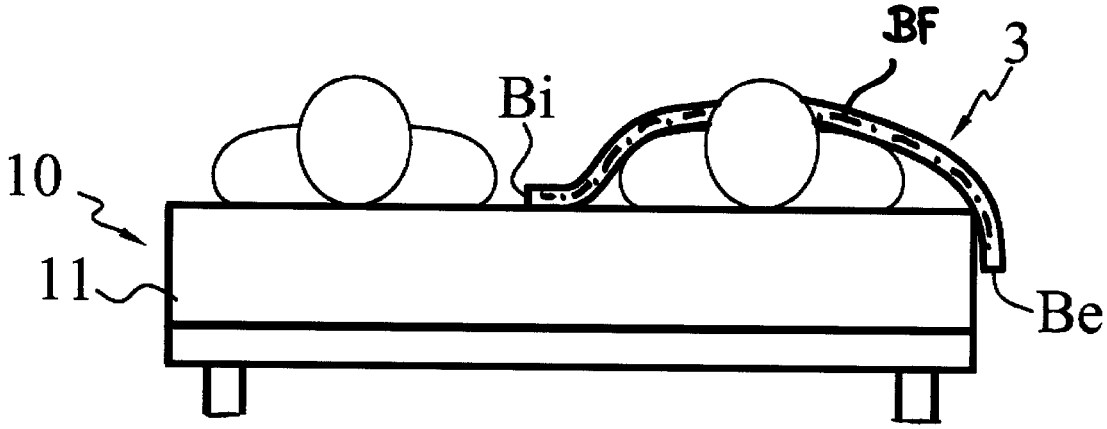

FIG 7. is a side view similar to FIG. 4 which shows the quilt bag of FIG. 6.

On these figures, the common structural and functional elements have the same alphanumeric references.

Figure 1:
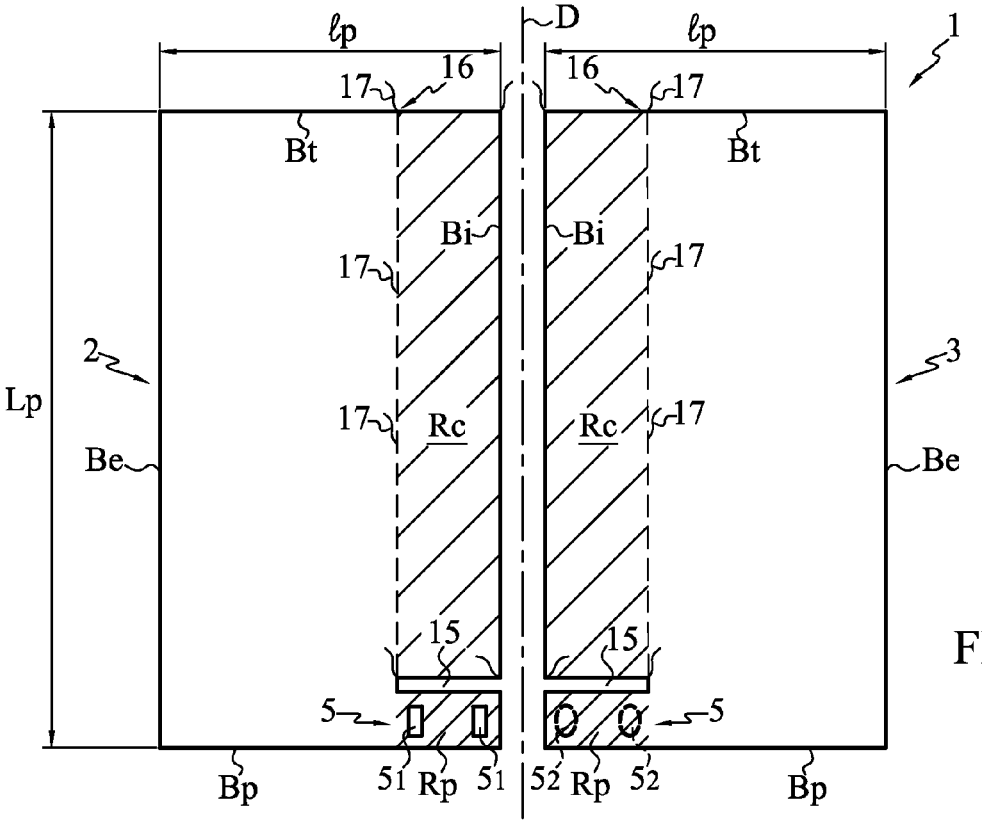
FIG. 1 is an elevation, from a top view, showing the elongate panels, parts of a household linen for a double bed according to the invention, separated from each other.

According to a first embodiment, more particularly illustrated in FIG. 1, the bed linen according to the invention, generally designated by the reference numeral 1, comprises two panels 2 and 3 which can be completely separated from the other.

The two panels 2, 3 are substantially the image of one another with respect to the imaginary line D. In the example illustrated, the two panels 2, 3 have a substantially identical shape and generally rectangular in the present case. This shape of the panels may also be adapted to the shape of the bed. Each panel 2, 3 has a width $I_p$, measured between an outer longitudinal edge and a inner longitudinal edge Bi of the corresponding panel, which is preferably greater than or equal to 80 cm in the case of a linen for a double bed for adults. Similarly, each panel 2, 3 has a length $L_p$ (measured between a transverse head edge Bt and a transverse foot edge Bp) which is preferably greater than or equal to 150 cm in the case of a linen for double bed for adults.

In normal use, the panels 2, 3 are intended to be used with each other by being connected at a foot region Rp intended to be located at the foot end of the bed as it will appear thereafter. To that end, each region foot Rp of a panel 2 comprises detachable connecting means 5 for cooperating with the detachable connecting means 5 of the other panel 3. These connecting means are arranged in a mirror fashion from a panel to the other. In the example shown the connecting means 5 comprise strips snap hooks $\mathbf{5}_1$ intended to cooperate with strips $\mathbf{5}_2$ loop attachment such as the two types of the strips sold under the VELCRO® trademark. The connecting means 5 thus formed allow to fasten and separate easily the panels while providing assembly strength.

Figure 2:
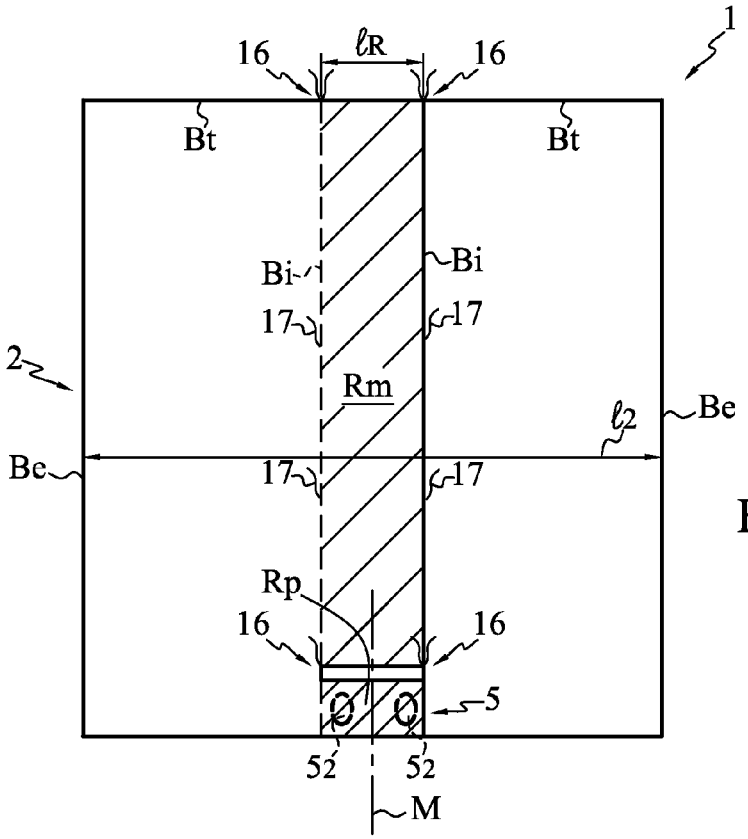
FIG. 2 is an elevation, from a top view, showing the two panels of FIG. 1 assembled into a household linen for a double bed according to the invention.

According to an essential characteristic of the invention, the panels 2, 3 are designed to, when assembled, partly overlap at a region Rc extending from the inner edge Bi of each panel in direction of the outer edge Be. The overlapping regions Rc superposed correspond, as shown in FIG. 2, in a median longitudinal region Rm of the linen 1 formed by assembling the two panels 2, 3. The median longitudinal region Rm and the overlapping regions Rc thus have a width $I_R$, measured between the two inner edges $B_i$ of the panels 2, 3, which is preferably greater than or equal to 15 cm or 30 cm in the case a linen for a double bed for adults. The household linen for a double bed according to the invention, then has a width $I_L$ less than the sum of the widths $I_p$ of panels 2, 3. In the case of a double bed for adults, the width $I_L$, measured between the two outer longitudinal edges Be of panels 2, 3, is preferably greater than or equal to 120 cm. In the case of a 160 cm double bed width $I_L$ may be greater than or equal 230 cm in order to provide a good comfort to users of the bed and a satisfactory aesthetic to the unused bed.

Figure 3:
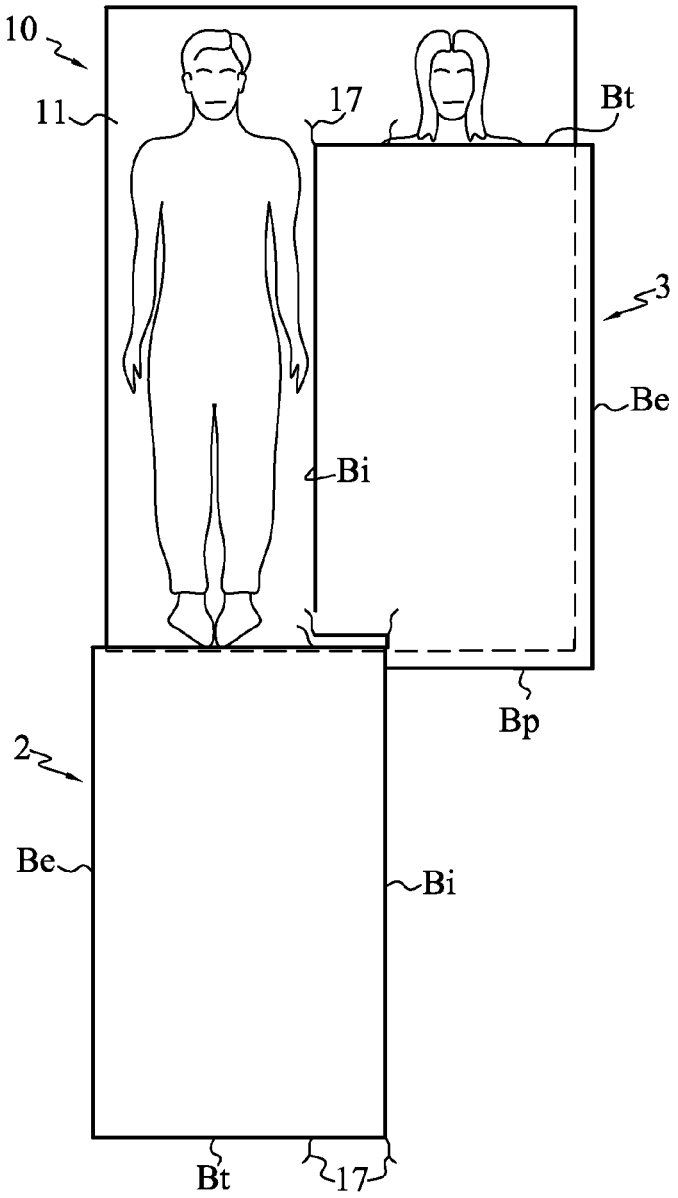
FIG. 3 is an elevation, view from above, showing the household linen shown in FIG. 2 fitted to a double bed with the left panel folded to the foot area so as to uncover a first user of the bed while the right panel is in the covering position of the second user.

The household linen 1 formed by the two panels 2, 3 is intended to be implemented on a double bed in the following manner. The household linen 1 is placed, as shown in FIG. 3, on the bed 10 so that the foot region of the panels is located at the foot of the bed, eg by being tucked under the mattress or mattresses 11. Insofar as the panels are free relative to each other over most of their length between the foot region Rp and the head region Rt (i.e. between the foot region Rp and their head edge Bt), one of the two users of the bed can be covered while the other user is uncovered as shown in FIG. 3. Moreover, insofar as each panel 2, 3 has a width $I_p$ greater than half the width of the linen 1 or a sheet as usually used, the user is largely covered by the panel 3, on both sides thereof as shown in FIG. 4. Thus, there is no cold air side inlet which ensures a great comfort to the user coated. It must also be noted that each panel preferably has a width sufficient to fall along the outer edge of the corresponding bed in order to offer good comfort and ensure a good aesthetic bed unused.

To allow each user to be either covered or uncovered without changing the orientation of household linen 1 according to the invention, each panel 2, 3 may include a cut-out 15 substantially transverse to the longitudinal axis M which extends from the inner edge of the corresponding panel Bi and thus separates the corresponding overlapping region Rc of the foot region Rp. Each cut-out 15 thereby contributing to the independence of the overlapping areas Rc. The cut-out may be a single slot. However in order to ensure a good appearance to the linen the cut-out has a U shape with edges of a few centimeters away. The dimensions of the household linen according to the invention will preferably be determined depending on the size of the bed and mattress so that the cut-out 15 is positioned just at the edge of the mattress. It should be noted that the size of the bed and mattress also affect the size of the bed linen according to the invention, including the widths of flap or fall in order to provide users a good comfort and aesthetics satisfactory when the bed is not used.

According to an alternative embodiment to allow the household linen to behave as a set of one piece, the two panels 2, 3 comprise means for releasable connection 16 complementary located at the overlap area of the panels. In the example shown the joining means 16 are formed by a pair of flexible links 17 to secure the panels temporary by way of tying, knotting or other. The implementation of flexible links has the advantage of avoiding any discomfort if contact between the user of the linen 1 and all the links on the overlap area. Preferably, the panels 2,3 comprise releasable joining means 16 at their top edge Bt or near their head region. Each panel may also include several links along the edge of the overlapping region.

Each panel according to the invention can form a sheet by presenting a single layer of fabric. Each panel can also form a cover or the like such as a quilted textile comprising several layers connected by sewing lines to any other type of connecting means. Each panel can also form a bag or envelope to receive a blanket or a feather bed.

Figure 5:
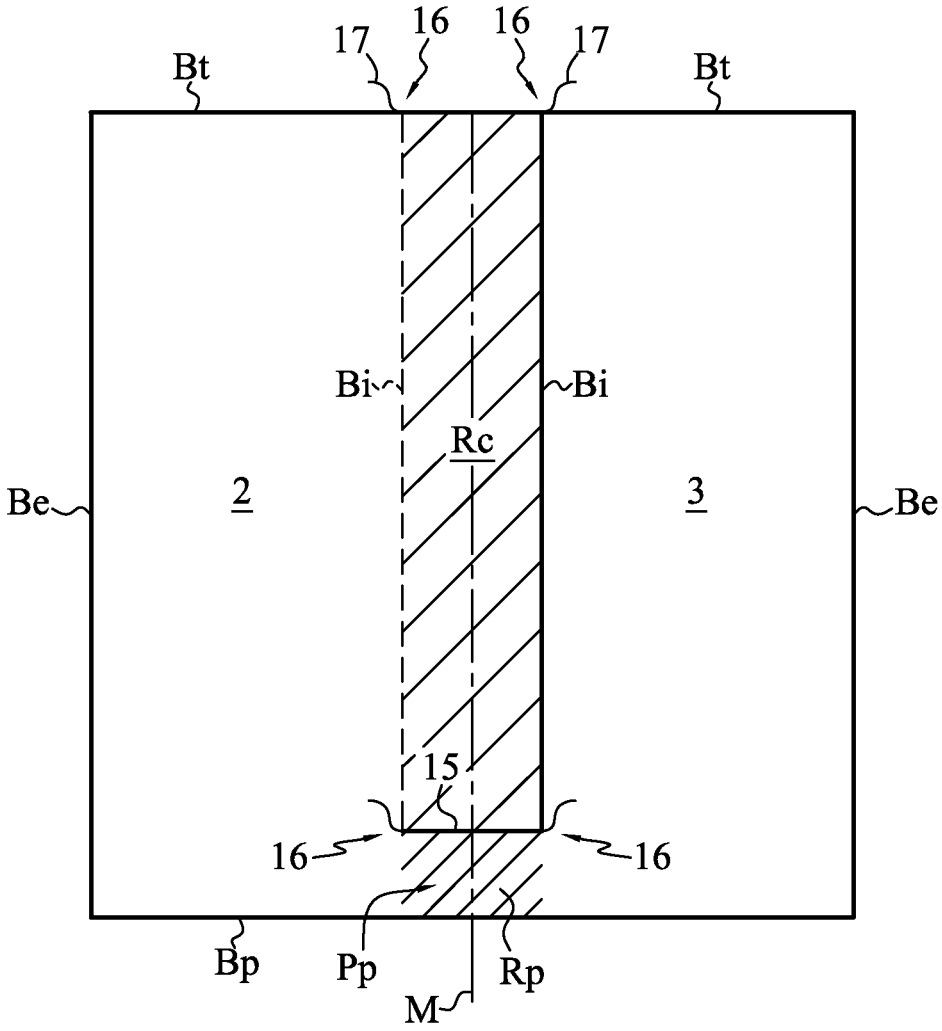
FIG. 5 is an elevation of another embodiment of a household linen according to the invention with two elongated panels which are not separable at the foot region.

According to the example described in connection with FIGS. 1 to 4, the linen 1 according to the invention is formed by the panels 2, 3 which may be disconnected or separated from each other. However, such an embodiment is not strictly necessary for the formation of a household linen according to the invention. Thus, FIG. 5 shows another embodiment of a household linen 1 according to the invention of which the foot regions of the panels 2, 3 form a single foot panel Pp so that the panels 2, 3 are not separable in the feet area.

FIG. 6 and FIG. 7 show a variant of a household linen according to the invention, each of the panels 2 and 3 forming a bag for a feather bed BF. In this variant the two panels 2, 3 each comprise beyond the feet region Rp and opposite to the head edge Bt, an extension E which is separated from the foot region by an inner cut-out 20 and a external cut-out 21. Extensions E allow longer linens for the large size beds. Furthermore, in the case of articulated beds extensions allow to form a fall concealing the mechanic of the bed when the legs are raised. Furthermore, the extensions E have lower or equal to those of the corresponding region of feet so that if the extensions are not used they can be retracted or returned within the foot region. The cut-outs 20 and 21 then ensure the holding of this folded position.

Furthermore, according to the examples described above separable panels are used together. However, it should be noted that each panel can be used alone on a single bed.

Of course, various other modifications may be made to the household linen according to the invention in the context of the appended claims.

The invention claimed is:

1. Household linen for a double bed with two elongated panels that:

are linked in at least one region, called the foot, intended to be located at the foot end of the bed, are free relative to each other on the major portion of their length up to a head edge located opposite the foot region, and partly overlap at a central longitudinal region of the linen, so that the width of the linen is less than the sum of the width of the two panels, the middle region extending between the foot region and the head edges, wherein each overlapping region of each panel is separated from the foot region by a cut-out substantially transverse to a longitudinal axis of the household linen.

2. Household linen for a double bed according to claim 1, wherein the foot region of the panels are separable and are connected by detachable connecting means.

3. Household linen for a double bed according to claim 2, wherein the detachable connecting means comprise stringers hook for cooperation with fastener stringers loop.

4. Household linen for a double bed according to claim 1, wherein the foot region of the panels form a single foot panel, so that the elongate panels are not separable.

5. Household linen for a double bed according to claim 1 wherein each overlapping region has a width, measured from an inner longitudinal edge of the corresponding panel and the inner longitudinal edge of the other panel, of at least 15 cm.

6. Household linen for a double bed according to claim 1, wherein the length of each panel measured from the transverse head edge and the transverse foot edge is at least 150 cm.

7. Household linen for a double bed according to claim 1, wherein the width of the linen measured between the outer longitudinal edges of the panels is at least 120 cm, each panel having a width, measured from the outer longitudinal edge and its inner longitudinal edge, greater than or equal to 80 cm.

8. Household linen for a double bed according to claim 1, wherein the two panels each comprise complementary demountable joining means located at the overlapping region for joining them.

9. Household linen for a double bed according to claim 8, wherein the demountable joining means comprise flexible fabric links.

10. Household linen for a double bed according to claim 8, comprising demountable joining means near the head end of the panels.

11. Household linen for a double bed according to claim 1, wherein each panel forms a bag adapted to receive a feather bed, a blanket, or a quilt.

12. Household linen for a double bed according to claim 11, wherein the two panels each comprise, beyond the foot region and the opposite to the head edge, an extension E which is separated from the foot region by an inner cut-out and an outer cut-out.

13. Household linen for a double bed according to claim 12, wherein the extensions have respective dimensions less than or equal to those of the corresponding foot region.

14. Household linen for a double bed according to claim 1, wherein each panel is at least partly made of a textile or an assembly of thick textile, blanket type or padded fabrics.

15. Household linen according to claim 1, wherein each panel comprises a single thickness of a fabric.

* * * * *